United States Patent [19]

Adams

[11] 4,111,667

[45] Sep. 5, 1978

[54] WOVEN POLYESTER BACKED FLEXIBLE COATED ABRASIVE HAVING MICROBALLOONS IN BACKSIZE

[75] Inventor: David G. Adams, Ballston Spa, N.Y.

[73] Assignee: Norton Company, Worcester, Mass.

[21] Appl. No.: 787,909

[22] Filed: Apr. 15, 1977

[51] Int. Cl.[2] ..... B24D 3/34; B24D 11/02

[52] U.S. Cl. ..... 51/295; 51/298 R; 428/265; 428/269

[58] Field of Search ..... 51/295, 298; 428/265, 428/269, 395, 396

[56] References Cited

U.S. PATENT DOCUMENTS

| | | | |
|---|---|---|---|
| 3,502,453 | 3/1970 | Baratto | 51/295 |
| 3,661,544 | 5/1972 | Whitaker | 51/295 |
| 3,778,241 | 12/1973 | Winter et al. | 51/298 |
| 3,787,273 | 1/1974 | Okrepkie et al. | 51/295 |
| 3,928,949 | 12/1975 | Wagner | 51/296 |
| 3,996,702 | 12/1976 | Leahy | 51/295 |
| 4,035,961 | 7/1977 | Pemrick et al. | 51/298 |

*Primary Examiner*—Donald J. Arnold

*Attorney, Agent, or Firm*—Rufus M. Franklin

[57] ABSTRACT

A flexible coated abrasive product particularly for belts heavy duty grinding includes a backsize containing microballoons to improve the durability of the product in use and to aid in the making of lapped belt joints in the backing.

4 Claims, No Drawings

WOVEN POLYESTER BACKED FLEXIBLE COATED ABRASIVE HAVING MICROBALLOONS IN BACKSIZE

FIELD OF THE INVENTION

The invention relates to heavy duty flexible coated abrasive products, particularly polyester backed coated abrasive for use in making belts.

BACKGROUND OF THE INVENTION

Coated abrasives made from dimensionally stable woven polyester fabric have recently come into commercial use. In heavy duty applications of such belts, particularly when made from the coarser grits of the new co-fused alumina-zirconia abrasives, one mode of failure of the product occurs because of grain shedding from excessive cracking of the maker coat due to flexing in use. Another mode of failure in such belts is mechanical rupture of the belt joints. The backing member of the present invention provides for the manufacture of improved lap type joints for forming endless abrasive belts.

While it is conventional in the coated abrasive art to apply a flexible backsize such as rubber modified backsize to the fabric to stiffen it, the present invention provides a modified backsize imparting improved properties to the coated abrasive product relative to grain retention and joint manufacture.

SUMMARY OF THE INVENTION

The objects of the invention are accomplished by incorporating from 2 to 10% by weight, equivalent to 10 to 50% by volume, of hollow microspheres into an otherwise conventional backsize coating on the reverse (non-abrasive) side of the woven polyester backing.

By microbeads or microballoons I mean hollow spheres of resin or glass having a diameter in the range of between 5 and 125 microns, a typical average diameter being 40 microns. The preferred microspheres are cured phenol-aldehyde spheres, but glass or thermoplastic resin spheres can also be used.

The incorporation of the beads into the backsize formulation enables a coating to be applied in no more than two steps which stiffens the fabric in an amount which would require 4 to 5 applications of conventional backsize and which is more readily sandblasted from the fabric along any given area where a lap joint, which requires removal of backsize from one end of the ends to be joined, is to be made in the coated abrasive product to form an endless belt. Such removal of conventional backsize coatings frequently requires such vigorous techniques that the tensile strength of the underlying polyester is reduced by 30 to 50%. The invention is particularly adaptable to heavy duty use as in belt grinding with co-fused aluminazirconia abrasive of grits 60 and coarser. The advantages of the invention however are also applicable to the use of more conventional fused aluminum oxide and silicon carbide abrasives.

The preferred phenolic microballoons have a density of from 0.1 to 0.3 grams/cc.

SPECIFIC EXAMPLE OF PREFERRED EMBODIMENT

Sateen polyester cloth, heat stretched and set, 96 × 42 thread count, about 7.2 oz./yd$^2$ and having a polyvinyl alcohol mill size (less than 1% by weight) applied prior to heat stretching (which may be removed by scouring prior to heat stretching) is saturated (padded) with a 50% solution of phenol formaldehyde resin and water at 150 – 250 cps viscosity and dried at 225° – 230° F. Weight added is 5.5 – 6.0 lb./SPMR (sand paper maker's ream). The resin is a resole.

Two coatings of backfill, in the amount of 4 pounds/SPMR (sand paper maker's ream) for the first coat and 5 pounds/SPMR for the second coat are then applied by conventional knife coating to the back of the dried cloth. The composition of the backfill is as follows:

| | Component | Parts by Weight |
|---|---|---|
| A. | Bisphenol-formaldehyde resin, 72% solids, F/P ratio 3.8 Bendix V1237A | 89 |
| B. | Copolymer latex | 125 |
| C. | Microballoons | 11.7 |
| D. | Calcium Carbonate particulate filler | 188.0 |
| E. | Water | 81 |
| F. | Nonionic surfactant (wetting agent) | 2 |

The copolymer latex or dispersion in the composition is commercially available as Dur-O-Cryl 820 from C. S. Tanner Chemical Co. Its composition in terms of monomers is as follows:

| Component | % By Weight |
|---|---|
| acrylonitrile | 12.6 |
| methyl methacrylate | 12.6 |
| butyl acetate | 16.5 |
| acrylamide | 1.0 |
| water | 51.4 |

The thus coated fabric is dried by heating at 225° F. A conventional front size and maker (such as disclosed in U.S. application Ser. No. 590,989, filed June 27, 1975) now U.S. Pat. No. 4,035,961 are applied, together with abrasive and finally an abrasive size coat. The preferred abrasive is co-fused alumina-zirconia.

What is claimed is:

1. A coated abrasive product comprising a fabric backing member for a flexible coated abrasive product of woven polyester yarns and having a backsize coating of phenolic resin composition including hollow microspheres of synthetic resins or glass in the amount of from 10 to 50% by volume of the coating and having a particle size in the range of from 5 to 125 microns whereby the coated fabric is stiffer than such fabric without inclusion of the hollow spheres and having abrasive grits bonded to the front surface thereof.

2. A coated abrasive as in claim 1 in which the abrasive grits are co-fused alumina-zirconia and the grit size is 60 grit, and coarser.

3. A fabric backing member for a flexible coated abrasive product of woven polyester yarns and having a non-abrasive backsize coating of a phenolic resin composition including hollow micro-spheres of synthetic resins or glass in the amount of from 10 to 50% by volume of the coating and having a particle size in the range of from 5 to 125 microns whereby the coated fabric is stiffer than such fabric without inclusion of the hollow spheres.

4. A backing member as in claim 3 in which the spheres are thermoset resin and have a density of from 0.1 to 0.3 grams per cubic centimeter.

* * * * *